US007124722B2

(12) United States Patent
Smith

(10) Patent No.: US 7,124,722 B2
(45) Date of Patent: Oct. 24, 2006

(54) REMOTE VARIABLE CAMSHAFT TIMING CONTROL VALVE WITH LOCK PIN CONTROL

(75) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 140 days.

(21) Appl. No.: 11/017,448

(22) Filed: Dec. 20, 2004

(65) Prior Publication Data

US 2006/0130789 A1 Jun. 22, 2006

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160

See application file for complete search history.

(56) References Cited

U.S. PATENT DOCUMENTS

| | | | | |
|---|---|---|---|---|
| 5,497,738 | A * | 3/1996 | Siemon et al. | 123/90.17 |
| 6,477,999 | B1 | 11/2002 | Markley | 123/90.17 |
| 6,481,402 | B1 | 11/2002 | Simpson et al. | 123/90.17 |
| 6,644,258 | B1 | 11/2003 | Smith | 123/90.17 |
| 6,668,778 | B1 | 12/2003 | Smith | 123/90.17 |
| 6,766,777 | B1 | 7/2004 | Simpson et al. | 123/90.17 |
| 6,772,721 | B1 | 8/2004 | Gradner et al. | 123/90.17 |
| 6,814,038 | B1 | 11/2004 | Smith | 123/90.17 |
| 2003/0196628 | A1 | 10/2003 | Smith | |
| 2004/0025822 | A1 | 2/2004 | Simpson et al. | |
| 2004/0055550 | A1 | 3/2004 | Smith | |
| 2005/0034695 | A1 | 2/2005 | Smith | |

FOREIGN PATENT DOCUMENTS

| | | |
|---|---|---|
| EP | 1128026 A2 | 8/2001 |
| EP | 1400661 A1 | 3/2004 |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A VCT system having a housing, a rotor, a locking pin, and a spool valve. The spool valve has a spool slidably located in a bore with a plurality of ports. The spool has a plurality of lands that block the ports. When the spool is in the advance position, the plurality of lands allow fluid through the ports from the retard chamber to the advance chamber. When the spool is in the retard position, the plurality of lands allow fluid through the ports from the advance chamber to the retard chamber. When the spool is in the null position, the plurality of lands allow fluid from a source to the advance and retard chambers. When the spool is in the locked position, the plurality of lands allow fluid supplied to one of the advance chamber or the retard chamber to move the locking pin to a locked position.

19 Claims, 7 Drawing Sheets

REMOTE VARIABLE CAMSHAFT TIMING CONTROL VALVE WITH LOCK PIN CONTROL

BACKGROUND OF THE INVENTION

1. Field of the Invention

The invention pertains to the field of variable cam timing systems. More particularly, the invention pertains to a remote control valve of a variable cam timing system with lock pin control.

2. Description of Related Art

Locking pins are commonly added to phasers to lock the position of the rotor relative to the housing. Some of examples of phasers with locking pins are U.S. Pat. No. 6,477,999, U.S. Pat. No. 6,481,402, U.S. Pat. No. 6,644,258, U.S. Pat. No. 6,668,778, U.S. Pat. No. 6,766,777, and U.S. Pat. No. 6,772,721.

U.S. Pat. No. 6,477,999 discloses a passage in the sprocket that extends parallel to and spaced from a longitudinal axis of rotation of the camshaft. A pin is slidable within the passage and is resiliently urged by a spring. A vane of the phaser carries a plate with a pocket for receiving an end of the pin. If sufficient oil pressure is provided, the oil pressure keeps the end of the pin from engaging the pocket in the vane, if not, the pin engages the pocket prohibiting movement of the vane. The pocket is in fluid communication with the oil used in the variable cam timing system.

U.S. Pat. No. 6,481,402 discloses a variable cam timing system in which the rotor and the housing are locked relative to each other by a pin when the spool is in the null position. Pressurized fluid from a source provides fluid to a lock pin passage off of the fluid line to either the advance chamber or the retard chamber.

U.S. Pat. No. 6,644,258 discloses a pin in the housing that locks the housing relative to the rotor. The oil pressure required to unlock the locking pin is higher than the pressure required to the hold the pin in the unlocked position.

U.S. Pat. No. 6,668,778 discloses a locking pin in hydraulic communication with a control circuit of a differential pressure control system (DPCS) of a variable cam timing system. When the control pressure is less than 50% duty cycle, a control signal commands the pin to engage and the VCT to move toward the mechanical stop. When the control pressure of the circuit is greater than 50% duty cycle, the locking pin disengages and the vane moves away from the mechanical stop.

U.S. Pat. No. 6,766,777 discloses a variable cam timing system in which a source oil passage provides oil to a spool valve and a locking pin. The locking pins is fed directly from the source. When the oil pump is on, the locking pin is unlocked. The spool position has no bearing on whether the locking pin is locked or unlocked.

U.S. Pat. No. 6,772,721 discloses a variable cam timing system having a rotor with two sets of vanes including vanes with a pair of shoulders. The shoulders position and block the passage way to a locking pin. In the advanced, retard, and null positions, the locking pin is unlocked. In the full advance position the locking pin is locked. The locking pin is pressurized when the spool is commanded to move away from its default position.

U.S. Pat. No. 6,814,038 discloses a variable cam timing system that utilizes the same spool that controls the VCT mechanism to actively control the locking pin. The positions of the spool's multiple lands directly influence whether source oil is supplied to both the locking pin and either the retard or advance chamber of the phaser.

FIGS. 5*a*–5*c* show a prior art cam torque actuated (CTA) phaser. In cam torque actuated phasers, torque reversals in the camshaft caused by the forces of opening and closing the valves move the vane 6. The control valve 4 in the CTA system allows the vanes 6 in the phaser to move by permitting fluid flow from the advance chamber 8 to the retard chamber 10 or vice versa, depending on the desired direction of movement. Positive cam torsionals are used to retard the phaser and negative cam torsionals are used to advance the phaser. During operation of the cam torque actuated phaser, the spool valve 4 pressurizes both the advance 8 and retard chambers 10 simultaneously and circulates oil to and from the spool valve 4 to the chambers 8, 10. Since, both chambers 8, 10 are pressurized simultaneously in the cam torque actuated phaser, a locking pin could never be added directly off of the chambers, since the pressure is never reduced to zero.

More specifically, in the null position, as shown in FIG. 5*a*, spool lands 9*a*, 9*b* block lines 12 and 13, and vane 6 is locked into position. Additional fluid is provided to the phaser to makeup for losses due to leakage. In this position, the locking pin in a bore 52 is in an unlocked position. Fluid is supplied to the locking pin from a source by line 50 and 54. The pressure of the fluid from source is greater than the force exerted by biasing spring 23 on locking pin 24. The locking pin 24 is prevented from venting by spool land 9*b*. Furthermore, in some engines the cam torque energy dissipates at high speeds, and the CTA VCT is not able to move without cam torque energy, because by the nature of the CTA hydraulic circuit, equal source pressure is applied to both sides of the vane, such that the VCT does not move.

To retard the phaser, as shown in FIG. 5*b*, hydraulic fluid from the supply enters line 18 and moves through check valve 19 to the spool valve 4. The spool valve 4 is internally mounted and comprises a sleeve 17 for receiving a spool 9 with lands 9*a*, 9*b*, and 9*c* and a biasing spring 5. A variable force solenoid or actuator 3, which is controlled by an ECU 2, moves the spool 9 within the sleeve 17. The spool is moved to the left by spring 5, and spool land 9*b* blocks line 13 and partially opens exhaust line 21, while spool land 9*c* blocks line 54 and source fluid to line 50 and locking pin 24. Without the pressure of source fluid, biasing spring 23 forces the locking pin 24 to a locked position. All or any fluid present in the bore 52 with the locking pin is vented to line 21. Lines 12 and 16 are open. From the spool 9, fluid enters line 16 through open check valve 15 into line 13 and to the retard chamber 10. At the same time fluid is exiting the advance chamber 8 through line 12 and fluid moves through the spool between lands 9*a* and 9*b* and back into line 16 where it feeds into line 13 supplying fluid to the retard chamber 10.

To advance the phaser, as shown in FIG. 5*c*, the spool is moved by the VFS 3 to the right, so that spool land 9*a* and 9*b* do not block line 13, line 16, or any exhaust lines and spool land 9*a* blocks the exit of fluid from line 12. Fluid from the retard chamber 10 exits the chamber through line 13, which routes the fluid through the spool 9 between lands 9*a* and 9*b*. The fluid then enters line 16 and travels through open check valve 14 into line 12 and the advance chamber 8. Additional fluid is supplied by the supply through line 18 and check valve 19 to the spool valve 4. In this position, the locking pin 24 is in an unlocked position. Source fluid and pressure is provided to the bore 52 of the locking pin 24 by lines 50 and 54. The pressure of the fluid from source is greater than the force exerted by biasing spring 23 on locking pin 24. The locking pin 24 is prevented from venting by spool land 9*b*.

SUMMARY OF THE INVENTION

A VCT system having a housing, a rotor, a locking pin, and a spool valve. The spool valve has a spool slidably located in a bore with a plurality of ports. The spool has a plurality of lands that block the ports. When the spool is in the advance position, the plurality of lands allow fluid through the ports from the retard chamber to the advance chamber. When the spool is in the retard position, the plurality of lands allow fluid through the ports from the advance chamber to the retard chamber. When the spool is in the null position, the plurality of lands allow fluid from a source to the advance and retard chambers. When the spool is in the locked position, the plurality of lands allows fluid supplied to one of the advance chamber or the retard chamber to move the locking pin to a locked position. This invention is of particular significance to a cam torque actuated VCT in that it allows active switching of the locking pin without adding separate hydraulic control lines to the locking pin.

DETAILED DESCRIPTION OF THE INVENTION

Internal combustion engines have employed various mechanisms to vary the angle between the camshaft and the crankshaft for improved engine performance or reduced emissions. The majority of these variable camshaft timing (VCT) mechanism use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the housing, and the chambers in the rotor, as well. The housing's outer circumference forms the sprocket, pulley or gear accepting drive force through a chain, belt, or gears, usually from the camshaft, or possible from another camshaft in a multiple-cam engine.

Figure 1:
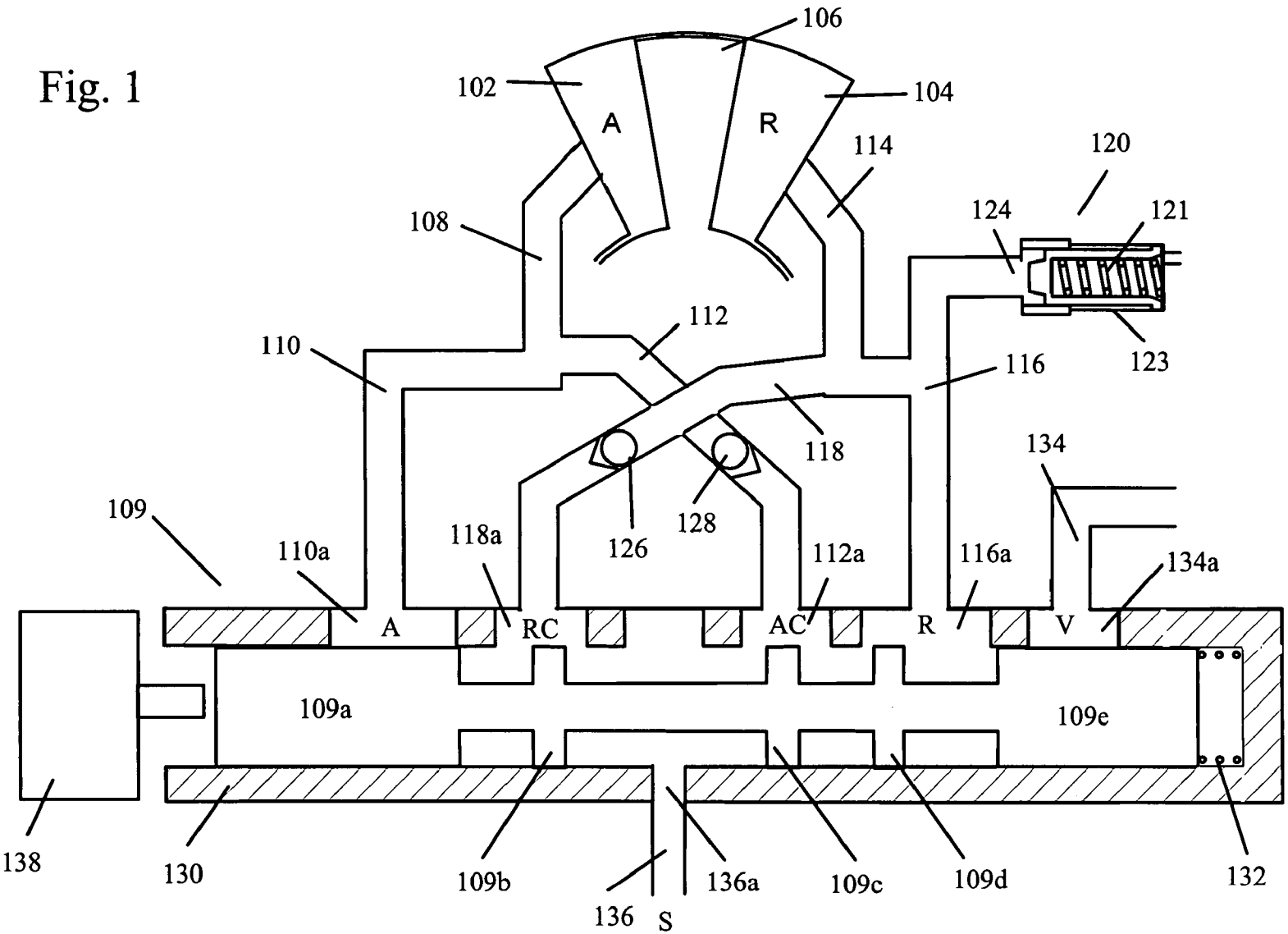
FIG. 1 shows a schematic of the phaser in the null position.

FIG. 1 shows a schematic of the phaser of the present invention in the null position. Hydraulic fluid enters the sleeve 130 through line 136 and supply port 136*a*. The sleeve 130 is located remotely from the phaser and has an open outer end, and inner surface, and an inner end for receiving biasing spring 132. The sleeve 130 slidably receives the spool 109 and its lands 109*a*, 109*b*, 109*c*, 109*d*, and 109*e*, which are separated from each other by a first groove, a second groove, a third groove, and a fourth groove. The spool 109 is biased against spring 132 by remotely located actuator 138. Arranged along the length of the sleeve 130, are ports 110*a*, 118*a*, 112*a*, 116*a*, and 134*a*, leading to the advanced line 110, the retard check valve line 118, the advance check valve line 112, the retard line 116, and the vent port line 134 respectively. The ports are arranged from the open outer end to the inner end that receives spring 132, in the following order: advance port 110*a* in fluid communication with the advanced line 110 and line 108 leading to the advance chamber 102; retard check valve port 118*a* in fluid communication with the retard check valve line 118 leading to line 114, the retard chamber 104, and locking pin 120; advance check valve port 112*a* in fluid communication with the advance check valve line 112 leading to line 108 and the advanced chamber 102; retard port 116*a* in fluid communication with the locking pin 120, line 114 leading to the retard chamber 104, and the retard check valve line 118; and vent port 134*a* in fluid communication with vent line 134. On an opposite inner surface of the sleeve 130, a supply port 136*a* and supply line 136 are present.

With the spool 109 in the null position, fluid from the supply line 136 and port 136*a* enters the remotely mounted sleeve 130 and supplies the advance chamber 102, the retard chamber 104, and the locking pin 120. In this position, the fluid supplied to the chambers 102, 104 maintains the position of the vane 106.

For fluid to get to the advance chamber 102, fluid moves from the supply port 136*a* of the spool 109 through the advanced check valve port 112*a* of the advance check valve line 112 containing check valve 128 to line 108. The check valve 128 allows fluid to move from the advance check valve port 112*a* to line 108 only.

For the fluid to get to the retard chamber 104, fluid moves from the supply port 136*a* of the spool 109 through the retard check valve port 118*a* of the retard check valve line 118 containing check valve 126 to retard line 116 and 114. The check valve 126 allows fluid to move from the retard check valve port 118*a* to lines 114 and the retard line 116 only. Fluid pressure is supplied to locking pin 120 in a bore 123 of the housing by retard port 116*a* and retard line 116 to either maintain or unlock the locking pin 120. The pressure of the fluid supplied is greater than the force exerted by biasing spring 121 in bore 123 of the locking pin 120, causing the pin 124 to unlock the rotor relative to the housing or vice versa. The biasing spring 121 of the locking pin 120 is designed such that the source pressure can maintain or keep the pin 120 from locking, even when fluid may be exiting the retard chamber 104. Spool lands 109*a* and 109*e* block the advanced port 110*a* of advanced line 110 and the vent port 134*a* of vent line 134 respectively.

Figure 2:
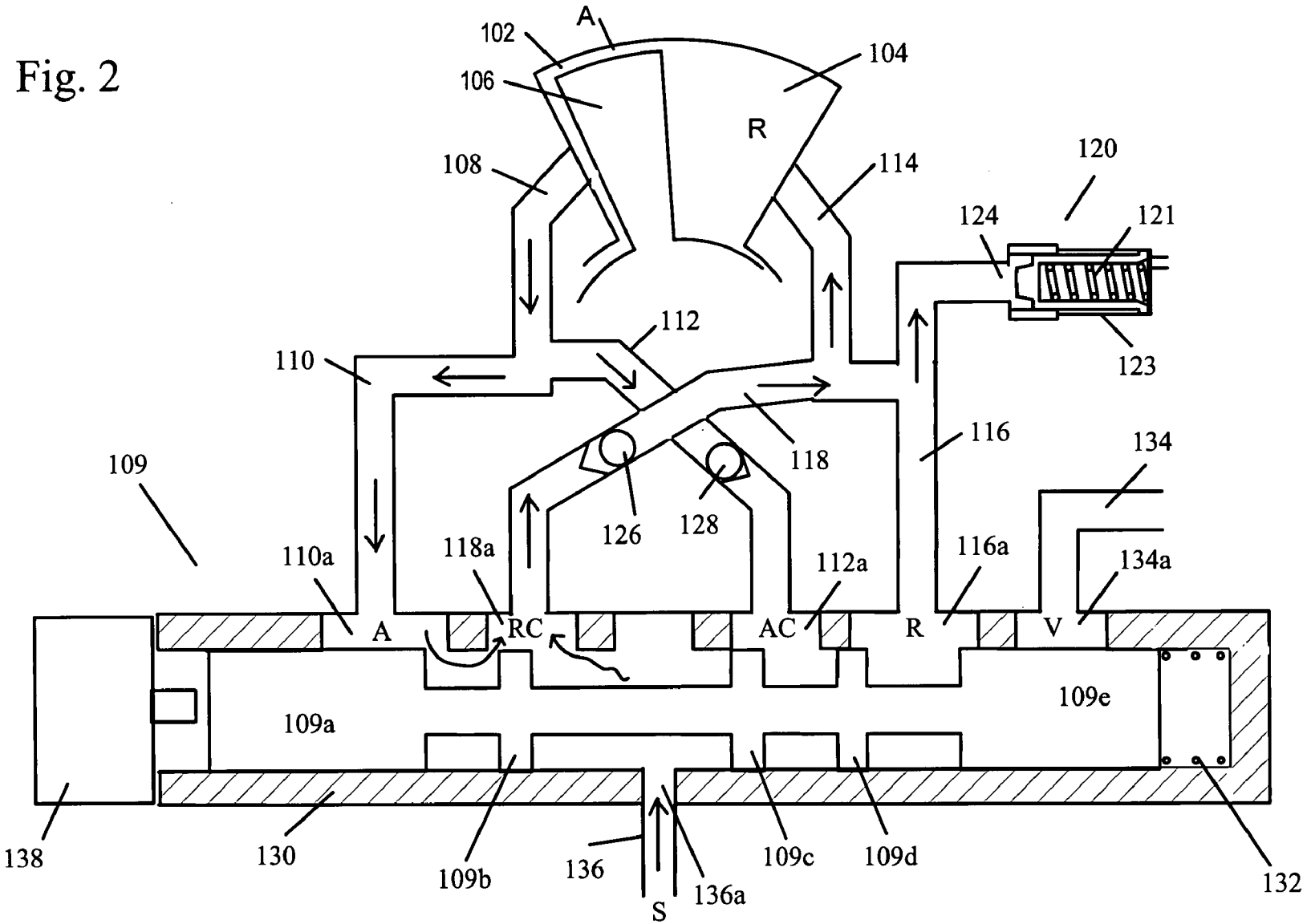
FIG. 2 shows a schematic of the phaser in the retard position.

When the force of spring 132 is greater than the force of actuator 138, the spool 109 is moved to the left as shown in FIG. 2 to the retard position. In the retard position, fluid exits the advance chamber 102 through line 108 to advance line 110, port 110*a*, and to advance check valve line 112. Fluid is prevented from exiting the advance check valve line 112 to port 112*a* by check valve 128. If any fluid were to get through the advance check valve port 112*a*, the fluid is blocked from circulating to other parts of the phaser by spool lands 109*c* and 109*d*. Fluid from the advance line port 110*a* flows to the retard check valve port 118*a* to the retard check valve line 118 through check valve 126 to line 114 and line 116. From line 114 fluid enters the retard chamber 104, moving the vane 106 to the left as shown. Fluid that enters retard line 116 biases the pin 124 against the force of the spring 121 to maintain the locking pin 120 in the unlocked position. Fluid is prevented from circulating to other parts of the phaser by spool lands 109*d* and 109*e*. Spool land 109*c* also blocks supply fluid from entering advance check valve port 112*a*. Spool land 109*d* also blocks supply fluid from entering the retard port 116*a*, and spool land 109*e* blocks any fluid in the phaser from exiting to the vent port 134*a* and vent port line 134.

Figure 3:
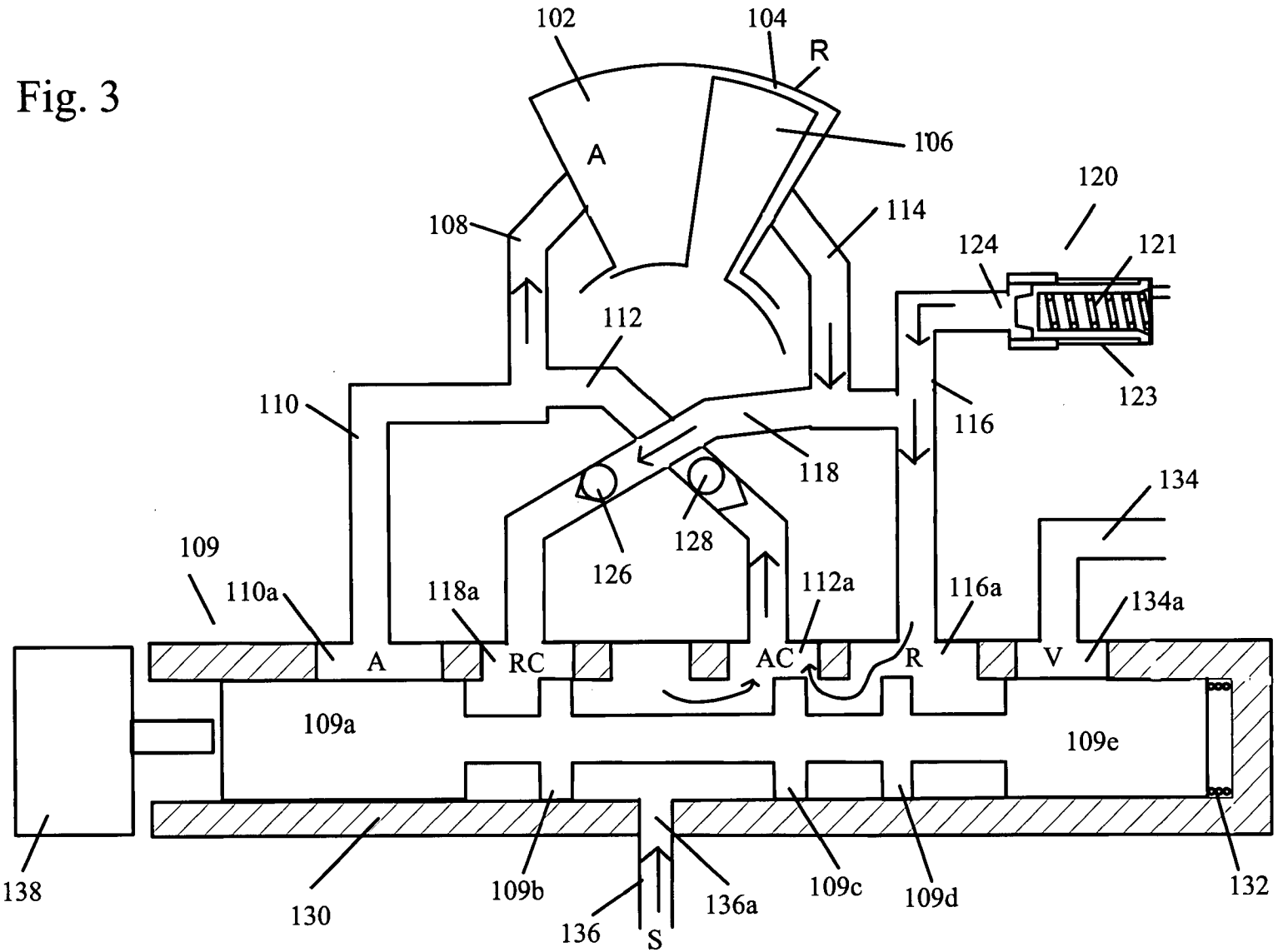
FIG. 3 shows a schematic of the phaser in the advance position.

When the force of the actuator 138 is greater than the force of the spring 132, the spool 109 is moved to the right as shown in FIG. 3, to the advance position. In the advance position, fluid exits the retard chamber 104 through line 114 to the retard line 116, port 116*a*, and the retard check valve line 118. Even though fluid is exiting from the retard chamber through retard line 116 and port 116*a* to the advance check valve line 112, the lock pin 120 is still pressurized an adequate amount to remain unlocked by source pressure. Fluid is prevented from exiting the retard check valve line 118 to port 118*a* by check valve 126. If any fluid were to get through the retard check valve port 118*a*, the fluid is blocked from circulating to other parts of the phaser by spool lands 109*a* and 109*b*. Fluid from the retard line port 116*a* flows to the advance check valve port 112*a* to the advance check valve line 112 through check valve 128 to line 108 and advance line 110. From line 108, fluid enters the advance chamber 102, moving the vane 106 to the right as shown. Fluid that enters the advance line 110 is prevented from circulating to other parts of the phaser through the spool valve by spool land 109*a*. Spool land 109*a* also blocks supply fluid from entering the advance line 110. Spool lands 109*a* and 109*b* block supply fluid from entering the retard check valve line 118 and port 118*a*. Spool land 109*e* blocks any fluid in the phaser from exiting to the vent port 13*a* and vent port line 134.

Figure 4:
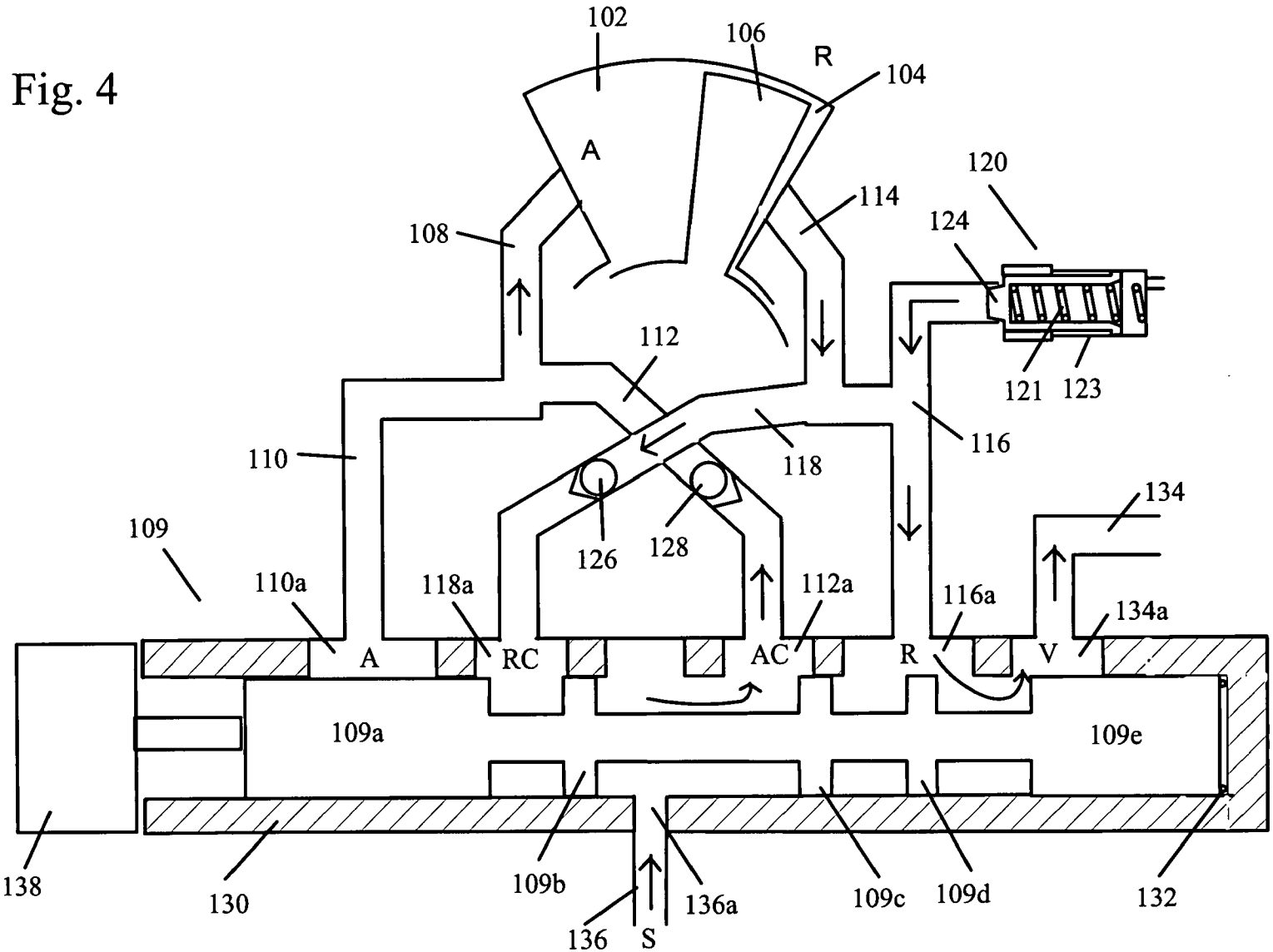
FIG. 4 shows a schematic of the phaser in the full advance stop position.
Figure 5A:
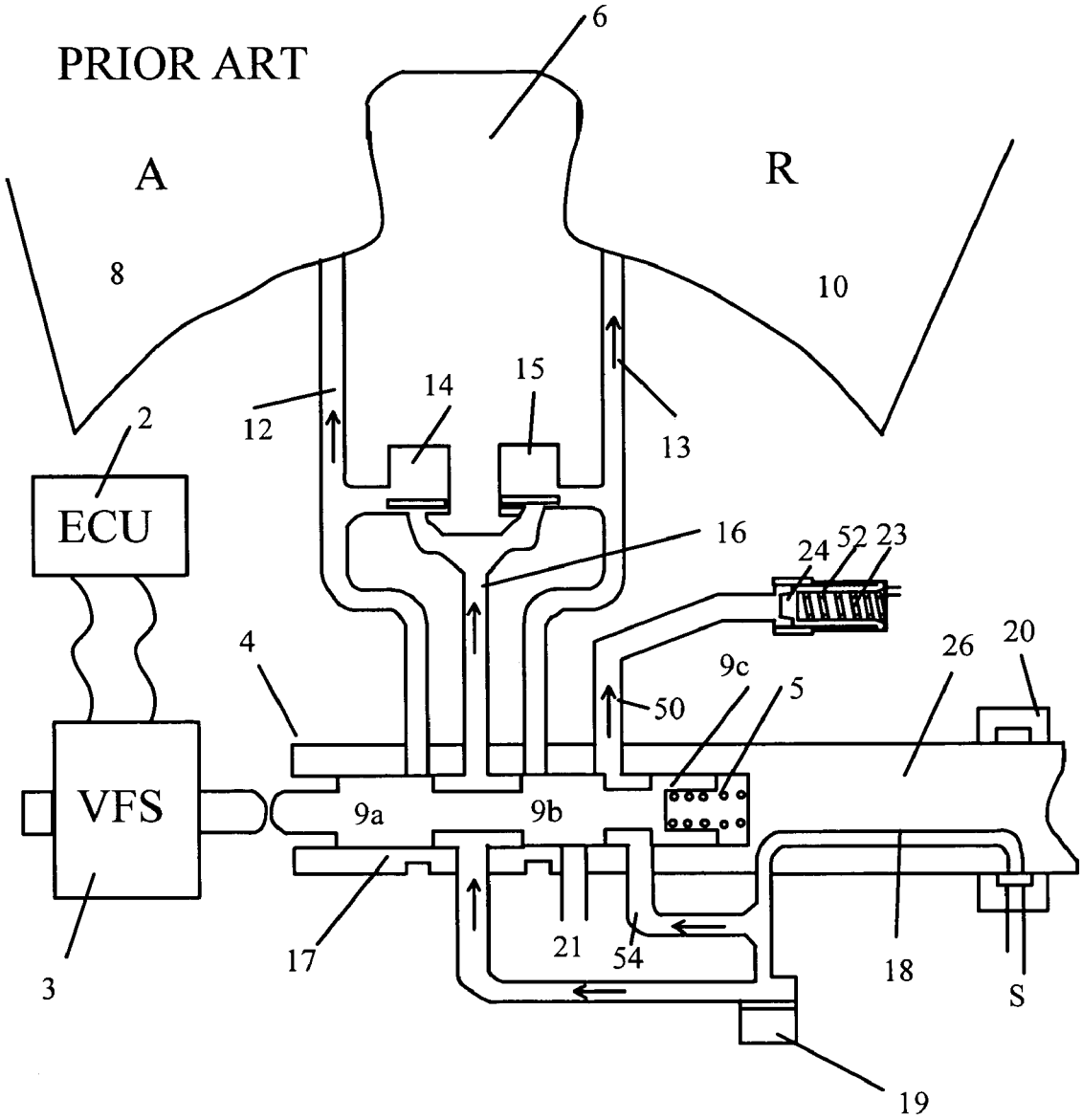
FIG. 5*a* shows a schematic of a prior art cam torque actuated phaser in the null position using a spool valve controlled locking feature.
Figure 5B:
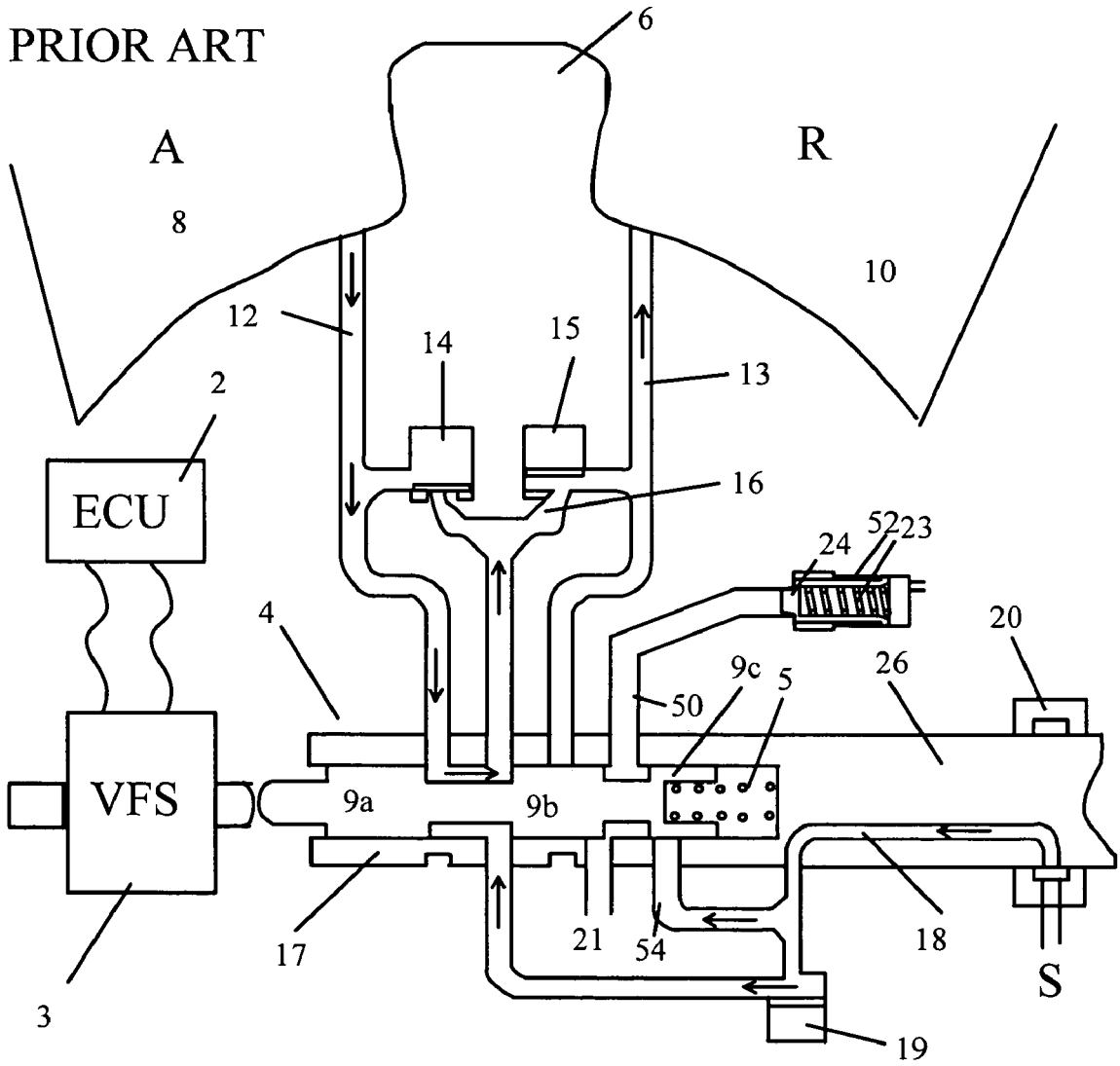
FIG. 5*b* shows a schematic of a prior art cam torque actuated phaser in the retard and locked position.
Figure 5C:
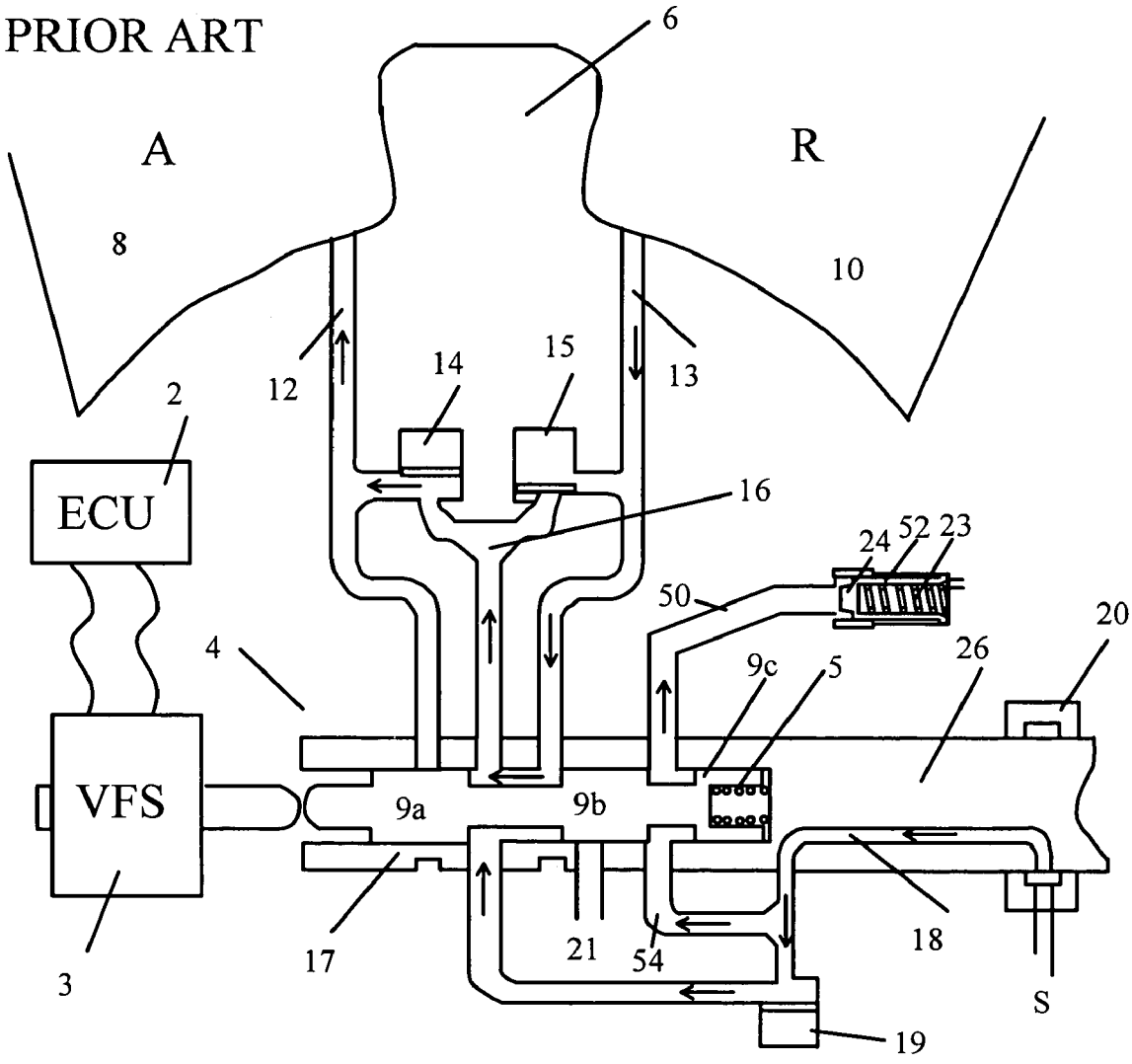
Fig. 5c PRIOR ART
FIG. 5*c* shows a schematic of a prior art cam torque actuated phaser in the advance position.

FIG. 4 shows the phaser in the full advance stop position. In this position, the spool 109 is moved as far to the right as is permitted by the sleeve. Spool land 109*a* prevents any fluid from exiting the advance line 110 to circulate to other parts of the phaser and the spool land 109*a* also blocks any supply fluid from entering the advance line 110. Spool lands 109*a* and 109*b* prevent supply fluid from entering the retard check valve line 118. Spool lands 109*b* and 109*c* prevent fluid, other than from the supply from entering the advance check valve line 112 and port 112*a*.

Fluid from the retard chamber 104 exits to line 114, the retard line 116, and the retard check valve line 118. Check valve 126 prevents fluid from the retard chamber from exiting the line to the spool valve. Fluid in the retard line exits through retard port 116*a* and moves through vent port 134*a* to the vent port line. All fluid from the retard chamber is fully exhausted to the vent port line 134 and vent port 134*a*. Since all the fluid is exhausted from the retard chamber 104 and is not recirculated to the advance chamber 102, the pressure in the retard chamber 104 drops to zero, and the force of the spring 121 is great enough to biase the pin 124 to move to a locked position, locking the rotor relative to the housing. The advance chamber 102 is filled with fluid, moving the vane 106 to the position shown in the figure, from the supply 136 through the advance check valve line 112 with check valve 128 to line 108, similar to a oil pressure actuated (OPA) or torsion assist (TA) phaser because one of the chambers, in this case the retard chamber 104 is being vented, and source fluid is prevented from refilling the chamber 104 and pressurizing the advance chamber 102. Therefore, the pressure may be used to push the VCT to a stop and have the lock pin 124 move to a locked position.

Either the advance chamber 102 or the retard chamber 104 may be exhausted and control the locking pin 120. Furthermore, the bore housing 123 the locking pin 120 may be in the housing or the rotor. The distribution or order of the ports along the length of the bore or sleeve is not limited to that shown in the figures.

Actuator 138 may be a variable force solenoid, a hydraulic solenoid, or a differential pressure control system (DPCS).

The sleeve 130 and spool valve 109 may also be centrally mounted in a bore of the rotor.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system for an internal combustion engine comprising:

a housing with an outer circumference for accepting drive force;

a rotor for connection to a camshaft coaxially located within the housing, the housing and the rotor defining at least one vane separating a chamber in the housing into an advance chamber and a retard chamber, the vane being capable of rotation to shift the relative angular position of the housing and the rotor;

a locking pin slidably located in a bore in one of the rotor or the housing, comprising a body having a diameter adapted to a fluid-tight fit in the bore, and an inner end with a portion adapted to fit in a recess in the other of the rotor or the housing the locking pin being moveable in the bore from a locked position to an unlocked position, the locking pin being released by pressure supplied from one of either the advance or retard chamber;

a spool valve comprising a spool slidably located in a bore with a plurality of ports, the spool comprising a plurality of lands that block the ports;

such that in a retard position, the plurality of lands allow fluid through the ports from the advance chamber to the retard chamber;

such that in an advance position, the plurality of lands allow fluid through the ports from the retard chamber to the advance chamber;

such that in a null position, the plurality of lands allow fluid from a source to the advance chamber and the retard chamber; and such that in a locked position, the plurality of lands allow fluid supplied to one of the advance chamber or the retard chamber to move the locking pin to a locked position and fluid from the other advance chamber or retard chamber to be vented.

2. The variable cam timing system of claim 1, further comprising a supply line extending from the source to the spool valve.

3. The variable cam timing system of claim 2, wherein the supply line further comprises a check valve.

4. The variable cam timing system of claim 1, wherein the bore is located in the rotor.

5. The variable cam timing system of claim 1, wherein the bore is located in the engine.

6. The variable cam timing system of claim 1, wherein the plurality of ports are comprised of an advance port, an advance check valve port, a retard port, a retard check valve port, and a vent port.

7. The variable cam timing system of claim 6, further comprising passages from the advance check valve port to the advance chamber and the retard check valve port to the retard chamber.

8. The variable cam timing system of claim 7, wherein the passages further comprise check valves.

9. A variable cam timing system for an internal combustion engine having at least one camshaft comprising:

a housing with an outer circumference for accepting drive force;

a rotor for connection to a camshaft coaxially located within the housing, the housing and the rotor defining at least one vane separating a chamber in the housing into an advance chamber and a retard chamber, the vane being capable of rotation to shift the relative angular position of the housing and the rotor;

a locking pin slidably located in a bore in one of the rotor or the housing, comprising a body having a diameter adapted to a fluid-tight fit in the bore, and an inner end with a portion adapted to fit in a recess in the other of the rotor or the housing, the locking pin being moveable in the bore from a locked position to an unlocked position;

a spool valve comprising a spool slidably located within a bore comprising an open outer end, an inner surface and an inner end and arranged along the bore, an advance port in fluid communication with the advance chamber, a retard check valve port in fluid communication with the retard chamber, a supply port, an advance check valve port in fluid communication with the advance chamber, a retard port in fluid communication with the retard chamber and the locking pin, and a vent port;

the spool comprising, in order from an outer end to an inner end, a first land, a first groove, a second land, a second groove, a third land, a third groove, a fourth land, a fourth groove, and a fifth land, wherein when the spool is in the a retard position, closest to the end of the bore, the advance port is in fluid communication with the advance chamber and the retard check valve port, the retard check valve port is in fluid communication with the supply, the advance port, the retard chamber, and the lock pin, such that the locking pin is in an unlocked position, the advance check valve port is blocked by the third and fourth spool lands, the retard port is blocked by the fourth and fifth lands, and the vent port is blocked by the fifth land;

wherein when the spool is in the null position, the advance port is blocked by the first land, the retard check valve port is in fluid communication with the supply, the retard chamber, the advance check valve port, the retard port, and the locking pin, such that the locking pin is in an unlocked position, the advance check valve port is in fluid communication with the supply, the retard check valve port, the advance chamber, and the retard port, the retard port is in fluid communication with supply, the retard check valve port, the advance check valve port, and the locking pin, the vent port is blocked by the fifth spool land;

wherein when the spool is in the advanced position, the advance port is blocked by the first spool land, the retard check valve port is blocked by the first and second spool lands, the advance check valve port is in fluid communication with the advance chamber, the supply, and the retard port, the retard port is in fluid communication with the retard chamber, the advance check valve port and the locking pin, such that the locking pin is in an unlocked position, and the vent port is blocked by the fifth land;

wherein when the spool is in the innermost advanced position, the advance port is blocked by the first land, the retard check valve port is blocked by the first and second lands, the advance check valve port is in fluid communication with the advance chamber and the supply, the retard port is in fluid communication with the retard chamber, the vent, and the locking pin, such that the locking pin is in a locked position, the vent port is in fluid communication with the retard port.

10. The variable cam timing system of claim 9, further comprising:

a supply line in fluid communication with a source and the supply port;

an advance line extending between the advance port to the advance chamber;

a retard line extending between the retard port, the retard chamber, and the locking pin;

an advance valve line extending between the advance check valve port and the advance line to the advance chamber;

a retard check valve line extending between the retard check valve port to the retard line to the retard chamber and the locking pin; and a vent line extending from the vent port to a sump.

11. The variable cam timing system of claim 10, wherein the advance valve line and the retard check valve line further comprise check valves.

12. A variable cam timing system for an internal combustion engine comprising:

a housing with an outer circumference for accepting drive force;

a rotor for connection to a camshaft coaxially located within the housing, the housing and the rotor defining at least one vane separating a chamber in the housing into an advance chamber and a retard chamber, the vane being capable of rotation to shift the relative angular position of the housing and the rotor;

a locking pin slidably located in a bore in one of the rotor or the housing, comprising a body having a diameter adapted to a fluid-tight fit in the bore, and an inner end with a portion adapted to fit in a recess in the other of the rotor or the housing the locking pin being moveable in the bore from a locked position to an unlocked position, the locking pin being released by pressure supplied from the advance chamber;

a spool valve comprising a spool slidably located in a bore with a plurality of ports, the spool comprising a plurality of lands that block the ports;

such that in a retard position, the plurality of lands allow fluid through the ports from the advance chamber to the retard chamber;

such that in an advance position, the plurality of lands allow fluid through the ports from the retard chamber to the advance chamber;

such that in a null position, the plurality of lands allow fluid from a source to the advance chamber and the retard chamber; and such that in a locked position, the plurality of lands allow fluid supplied to the advance chamber to move the locking pin to a locked position and fluid from the retard chamber to be vented.

13. The variable cam timing system of claim 12, further comprising a supply line extending from the source to the spool valve.

14. The variable cam timing system of claim 13, wherein the supply line further comprises a check valve.

15. The variable cam timing system of claim 12, wherein the bore is located in the rotor.

16. The variable cam timing system of claim 12, wherein the bore is located in the engine.

17. The variable cam timing system of claim 12, wherein the plurality of ports are comprised of an advance port, an advance check valve port, a retard port, a retard check valve port, and a vent port.

18. The variable cam timing system of claim 17, further comprising passages from the advance check valve port to the advance chamber and the retard check valve port to the retard chamber.

19. The variable cam timing system of claim 18, wherein the passages further comprise check valves.

* * * * *